US007270086B2

(12) United States Patent
Franke et al.

(10) Patent No.: US 7,270,086 B2
(45) Date of Patent: Sep. 18, 2007

(54) STEAM GENERATOR

(75) Inventors: Joachim Franke, Altdorf (DE); Rudolf Kral, Stulln (DE)

(73) Assignee: Siemens Aktiengesellschaft, Munich (DE)

( * ) Notice: Subject to any disclaimer, the term of this patent is extended or adjusted under 35 U.S.C. 154(b) by 84 days.

(21) Appl. No.: 10/543,602

(22) PCT Filed: Dec. 8, 2003

(86) PCT No.: PCT/EP03/13879

§ 371 (c)(1),
(2), (4) Date: Jul. 28, 2005

(87) PCT Pub. No.: WO2004/068032

PCT Pub. Date: Aug. 12, 2004

(65) Prior Publication Data

US 2006/0075977 A1 Apr. 13, 2006

(30) Foreign Application Priority Data

Jan. 31, 2003 (EP) ..... 03002243

(51) Int. Cl.
*F22B 37/14* (2006.01)

(52) U.S. Cl. ..... 122/7 R; 122/258; 122/1 B

(58) Field of Classification Search ..... 122/7 R, 122/1 B, 469, 461, 465
See application file for complete search history.

(56) References Cited

U.S. PATENT DOCUMENTS 5,311,844 A * 5/1994 Polcer ..... 122/470
5,575,244 A * 11/1996 Dethier ..... 122/406.1
6,019,070 A 2/2000 Duffy
6,092,490 A * 7/2000 Bairley et al. ..... 122/7 R
6,189,491 B1 * 2/2001 Wittchow et al. ..... 122/1 C
6,868,807 B2 * 3/2005 Franke et al. ..... 122/406.4
6,957,630 B1 * 10/2005 Mastronarde ..... 122/406.4

FOREIGN PATENT DOCUMENTS

| | | |
|---|---|---|
| DE | 11 76 155 | 8/1964 |
| DE | 197 00 350 A1 | 7/1998 |
| EP | 0 944 801 B1 | 9/1999 |
| JP | 03 221702 | 9/1991 |

* cited by examiner

*Primary Examiner*—Gregory Wilson

(57) ABSTRACT

A stream generator wherein a continuous evaporating heating surface is disposed in a heating gas duct through which a heating gas flows in an approximately horizontal manner. The continuous evaporating heating surface comprises a plurality of steam-generating pipes which are connected in a parallel manner enabling flowthrough of a flow medium, and is configured in such a manner that a steam-generating pipe which is heated more than another stream-generating pipe of the same continuous evaporating heating surface has a higher throughput of a flow medium compared to the other steam-generating pipe. An object is to produce a particularly low-cost steam generator exhibiting particularly high mechanical stability with different thermal loads. The steam-generating pipe respectively comprises a riser pipe piece which can be cross-flown in an upward direction and which is arranged in an approximately vertical manner in relation to the flow medium; a down pipe piece which can be cross-flown in a downward direction downstream from said flow medium side and another riser pipe piece which can be cross-flown in an upward direction by a flow medium and which is arranged in an approximately vertical manner downstream from the latter flow medium side. Preferably, the other riser pipe piece of the respective steam-generating pipe is arranged in the heating gas duct, when seen in the direction of the heating gas, between the riser pipe piece associated therewith and the down pipe piece associated therewith.

6 Claims, 1 Drawing Sheet

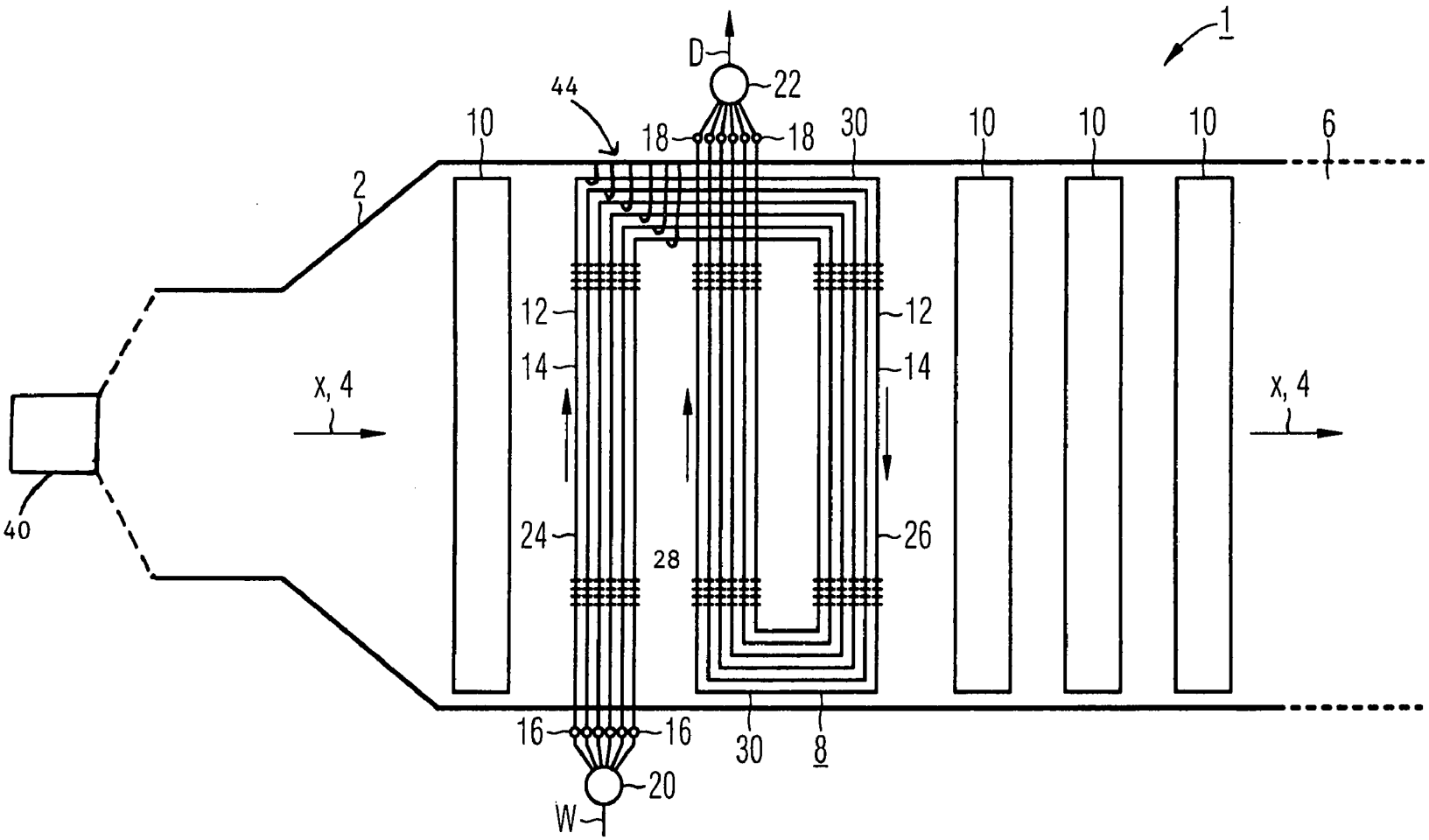
1
6
10
10
10
30
22
18
D
18
44
10
2
x, 4
x, 4
12
14
26
8
30
28
16
20
W
16
12
14
24
40

STEAM GENERATOR

CROSS REFERENCE TO RELATED APPLICATIONS

This application is the US National Stage of International Application No. PCT/EP2003/013879, filed Dec. 8, 2003 and claims the benefit thereof. The International Application claims the benefits of European application No. 03002243.8 EP filed Jan. 31, 2003, all of the applications are incorporated by reference herein in their entirety.

FIELD OF INVENTION

The invention relates to a steam generator wherein a continuous evaporating heating surface is disposed in a heating gas duct through which gas flows in an approximately horizontal manner, said continuous evaporating heating surface comprising a plurality of steam-generating pipes which are connected in a parallel manner, enabling flowthrough of the flow medium and is configured in such a manner that a steam generating pipe which is heated more than another steam generating pipe of the same continuous evaporating heating surface has a higher throughput of the flow medium compared to the other steam-generating pipe.

BACKGROUND OF INVENTION

In a gas and steam turbine system the heat contained in the expanded operating medium or heating gas from the gas turbine is used for the generation of steam for the steam turbine. The heat is transferred in an exhaust heat steam generator connected downstream from the gas turbine, in which a number of heating surfaces are usually arranged for water pre warming, for evaporation of the water and for steam superheating. The heating surfaces are connected into the water-steam circulation of the steam turbine. The water-steam circulation usually comprises a number of pressure stages, for example three, with each pressure stage able to have a continuous evaporating heating surface.

There are a number of alternative design concepts to be considered for the steam generator connected downstream from the gas turbine on the heating gas side as a waste heat steam generator, namely a throughflow steam generator design or a recirculating steam generator design. With a throughflow steam generator the heating of the steam generator pipes provided as evaporation pipes leads to an evaporation of the flow medium in the steam-generating pipes in a single pass. By contrast, with a natural or forced circulation steam generator, the water introduced into the circulation is only partly evaporated when it passes through the evaporation pipes. The water not evaporated in this case is fed back again, once it has been separated from the steam generated, to the same evaporation pipes for a further evaporation.

By contrast with a natural or forced circulation steam generator a throughflow steam generator is not subject to any pressure limiting so that fresh steam pressures far in excess of the critical pressure of water ($P_{Kri}$≈221 bar)—where only small differences in density between liquid-like and steam-like medium—are possible. A high fresh steam pressure promotes a high degree of thermal efficiency and thereby low $CO_2$ emissions of a fossil fuel-fired power station. In addition a throughflow steam generator has a simpler construction compared to a recirculating steam generator and can thus be manufactured at particularly low cost. The use of a steam generator designed in accordance with the flowthrough principle as a waste heat steam generator of a gas and steam turbine system is thus particularly useful for achieving a high overall efficiency of the gas and steam turbine system with a simple construction.

A waste heat steam generator constructed in a horizontal manner has particular advantages as regards the effort involved in manufacturing it, but also as regards the required maintenance work, the heating medium or heating gas, that is the waste gas from the gas turbine, being fed in an approximately horizontal direction of flow through the steam generator. In a horizontal-design throughflow steam generator the steam-generation pipes of a heating surface can however be subjected to widely different heating, depending on their positioning. Especially with steam generation pipes connected on the output side to a common collector, a different heating of individual steam generation pipes can result in a merging of steam flows with sharply differing steam parameters and thereby to undesired losses of efficiency, especially to a comparatively reduced effectiveness of the heating surface involved and thereby to reduced steam generation. A different heating of adjacent steam-generating pipes can also, especially in the inlet area of collectors, lead to damage to the steam-generating pipes or to the collector. The use of a horizontal design of throughflow steam generator, which is desirable per se, as a waste heat steam generator for a gas turbine, can thus present significant problems as regards a sufficiently stabilized flow feed.

A steam generator is known from EP 0 944 801 B1 which is suitable for an arrangement as a horizontal design and also features the stated advantages of a throughflow steam generator. To this end the known steam generator is designed as regards its continuous evaporating heating surface so that a steam-generatng pipe which is heated more in comparison with a further steam-generating pipe of the same continuous evaporating heating surface has a higher throughflow of the flow medium compared to the further steam-generating pipe. The continuous evaporating heating surface of the known steam-generator thus exhibits a self-stabilizing behavior in the type of flow characteristics of a natural recirculating continuous evaporating heating surface (natural recirculating characteristic) on occurrence of different heating of individual steam-generating pipes which without requiring any outside influence, leads to a balancing out of the outlet-side temperatures even at differently heated, flow-medium side steam-generating pipes connected in parallel. However the known steam generator is comparatively expensive to construct, especially as regards the water and/or heat-side distribution of the flow medium.

SUMMARY OF INVENTION

An object of the invention is thus to specify a steam generator of the type stated above which is particularly cheap to build and which also exhibits an especially high mechanical stability at different thermal loading.

This object is achieved accordance with the invention by one or each of the steam-generating pipes having an almost vertically arranged riser pipe piece through which the flow medium can flow in an upwards direction, a down pipe piece connected downstream on the flow medium side, arranged almost vertically and through which the flow medium can flow in an downwards direction and a further riser pipe piece arranged on the flow medium side downstream from the down pipe piece, through which the flow medium can flow in an upwards direction.

In this case The invention uses as its starting point the consideration that in a steam generator that can be constructed with especially low installation and manufacturing outlay for an operating behavior which is especially stable and especially insensitive in relation to differences in the thermal stress, the design principle employed for the known steam generator, a natural recirculating characteristic for a continuous evaporating heating surface, is to be explicitly extended and further improved. The steam generator continuous evaporating heating surface should in this case be designed for application of a comparatively small mass volume density with comparatively low frictional pressure loss.

An especially simple and thereby also robust construction can be achieved in this case by the heating surface being designed in a particularly simple way especially as regards collection and distribution of the flow medium. In this case the heating surface is suitably embodied for execution of all parts of the complete evaporation process, that is of pre-warming, evaporation and at least part superheating in just one single stage, that is without intermediate components to collect and/or distribute the flow medium. There is generally provision for additional heating surfaces for pre-warming of the feed water or for further superheating. In order in this case to on the one hand be able to undertake all of the stated parts of the process completely in the relevant steam-generating pipe and on the other hand to allow sufficient flexibility in the adaptation of the steam-generating pipes to the requirements of these process parts and the method in the heating gas duct, each steam-generating pipe comprises three segments connected one after the other on the flow medium side.

In order to also support the desired natural recirculation characteristic of the through flow in this design a division of the steam-generating pipes of the continuous evaporator heating surface into at least three segments (of parallel pipes) is provided, with the first segment comprising all riser pipe pieces through which the flow is in an upwards direction. Correspondingly the second segment comprises all down pipe pieces and the medium flows through these in a downwards direction so that the flow is supported automatically by the inherent weight of the flow medium. In this case the down pipe pieces forming the second segment of each steam-generating pipe in the heating and gas duct are arranged, viewed in the direction of the heating gas, behind the riser pipe pieces assigned to them in each case. The third segment comprises all further riser pipe pieces and the flow material flows upwards through it.

In an especially advantageous embodiment the segments of the steam-generating pipe or of each steam-generating pipe in the heating gas duct are positioned such that the heating requirement of each segment—especially with respect to the stage in the evaporation process provided there—is adapted in a particular way to the local heat provided in the heating gas duct. To this end the further riser or pipe pieces forming the third segment of each steam-generating pipe are expediently arranged in the heating gas duct, viewed in the heating gas direction, between the riser pipe pieces of the first and the down pipe pieces of the second segment assigned to them. In other words: The steam-generating pipes are expediently positioned spatially in the heating gas duct so that the first segment viewed from the flow medium-side is arranged upstream from the third segment or further riser pipe piece viewed from the flow medium side and the second segment or down pipe piece viewed from the flow medium-side is arranged upstream on the heating gas side from the third segment or further riser pipe piece viewed from the flow medium side.

In this type of arrangement the first riser pipe piece which is used for partial preheating and already to a large extent for evaporation of the flow medium is thus subjected to a comparatively strong heating by the heating gas in the hot smoke gas area. This ensures that in the overall range of loads, flow medium flows out of the relevant first riser pipe piece with a comparatively high steam component. This leads, on subsequent introduction into the downstream down pipe piece, to an increase in a steam bubbles against the flow direction of the flow medium which would be bad for the flow stability in the down pipe piece being explicitly avoided. Arranging the down pipes piece in the comparatively cold smoke gas area and arranging the second riser pipe piece between the first riser pipe piece and the down pipe piece, that is on the smoke gas side before the down pipe piece, thus achieves an especially high degree of efficiency with higher operational safety, in which case the first riser pipe piece fulfills the function of a pre-evaporator.

An especially simple design of the continuous evaporating heat surface on the one hand and an especially low mechanical stress of the continuous evaporating heat surface, even with different thermal loads, on the other hand can be achieved in that in a further or alternatively advantageous design the riser pipe piece of one or all of each steam-generating pipe with the down pipe piece assigned to it as well as the down pipe piece of one or all of each steam-generating pipe with the further riser pipe piece assigned to it is connected on the flow medium-side via a cross flow piece in each case.

This type of arrangement is especially suitable for expansion compensation with alternating thermal loading in that the riser pipe piece and the down pipe piece or the cross flow piece connecting the down pipe piece and the further riser pipe piece serve in this case namely as expansion bends which can compensate for the relative changes in length of the riser pipe piece and/or the down pipe piece and/or the further riser pipe piece in any event. The cross flow piece thus provides a diversion of the steam-generating pipes in the upper area of a first evaporator stage produced by the riser pipe pieces with direct forwarding and new diversion in the lower area of a second evaporator stage formed by the down pipe pieces as well as a diversion and forwarding of the steam-generating pipes in the lower area of the second evaporating stage into a third evaporator stage formed by the further riser pipe pieces.

The cross flow piece or each cross flow piece is advantageously laid within the heating gas duct. Alternatively the cross flow piece can however also be routed outside the heating gas duct, especially if, because a possible draining of the continuous evaporation heating surface is required, a drain water collector is to be connected to the cross flow piece.

The steam-generating pipes can be grouped together within the heating gas to form rows of pipes of which each row features a number of steam-generating pipes arranged alongside one another at right angles to the heating gas direction. With this type of embodiment the steam-generating pipes are advantageously routed such that the riser pipe pieces forming the row of pipes heated most strongly, that is the first row of pipes viewed in the heating gas direction, is assigned to the row of down pipe pieces heated the least of the last row of pipes viewed in the heating gas direction. In addition the down pipe and riser pipe pieces of a number of steam-generating pipes are expediently positioned in the heating gas duct relative to one another such that a down pipe piece lying relatively far back when viewed in the heating gas direction is assigned to a further riser pipe piece lying comparatively far forward viewed in a heating gas direction.

Through this type of arrangement the comparatively strongly heated further riser pipe pieces are fed with a comparatively weakly preheated flow medium flowing out of the down pipe pieces.

To ensure the natural recirculation characteristic desired for a sterile throughflow of the pipes, the relevant steam-generating pipe is advantageously embodied such that it merely comprises a riser pipe piece as well as a down pipe piece connected to it downstream on the flow medium side as well as a further riser pipe piece connected downstream of the latter on the flow medium side.

Expediently the steam generator is used as a waste heat steam generator of a gas and steam turbine system. In this case the steam generator is advantageously connected downstream from a gas turbine on the heating gas side. In this circuit an additional firing unit can expediently be arranged behind the gas turbine to increase the heating gas temperature.

The advantages obtained with the invention consist in particular in the fact that with a three-stage embodiment of the steam-generating pipes with a riser pipe piece through which the medium can flow in an upwards direction, a down pipe piece through which the medium can flow in a downwards direction and a further riser pipe piece connected downstream from this on the flow medium side through which the medium can flow in an upwards direction, the complete execution of the evaporation, that is part preheating, evaporation and part superheating can be achieved in just one stage and without intermediate connection of components for collection or distribution in an especially simple design. In this case for example a layout without water separator is possible, with an undesired water surge in the superheater being able to be avoided or kept low on startup, in that at the beginning of the startup process exclusively the relevant first riser pipe piece is filled with water, that after the beginning of the startup process on passage through the subsequent pipe pieces evaporation takes place completely or to a sufficiently high degree.

Heated evaporator systems with an upwards flow do usually lead to flow instabilities which are simply not tolerable for use in force throughflow evaporators. For a throughflow with comparatively low mass density flows the comparatively low friction pressure loss means that a natural recirculation characteristic of the steam generator can be achieved in a reliable manner, which leads on multiple heating of a steam-generating pipe compared to a further steam-generating pipe to a comparatively higher throughflow of the flow medium in the multiply heated steam-generating pipe. This natural circulation characteristic guarantees, even when upwards-flowed pipe pieces are used, a sufficiently stable and reliable throughflow of the steam-generating pipes.

Such a characteristic can also be achieved with especially low constructional and installation outlay, in that the down pipe piece is connected directly downstream of the riser pipe piece assigned to it in each case or the further riser pipe piece is directly connected downstream from the down pipe piece assigned to it in each case and without intermediate connection of an expensive collection or distribution system. The steam generator thus exhibits a comparatively low system complexity with especially stable flow behavior. In addition both the riser pipe piece and also the down pipe piece and the further riser pipe piece connected downstream from this of each steam-generating pipe can be attached as a hanging unit in the area of the housing cover of the heating gas duct, with a free lengthwise expansion being allowed in the lower area. These types of lengthwise expansion resulting from thermal effects are now compensated for by the cross flow piece connecting the relevant down pipe piece with the riser pipe piece or the further riser pipe piece with the down pipe piece so that no strains arise as a result of thermal effects.

BRIEF DESCRIPTION OF THE DRAWING

Exemplary embodiments of the invention are explained in greater detail with reference to a drawing. In this drawing the FIGURE shows a simplified diagram of a lengthwise cross piece or a steam generator in a horizontal design.

DETAILED DESCRIPTION OF INVENTION

The steam generator 1 in accordance with the FIGURE is connected downstream as a type of waste heat steam generator from a gas turbine 40 not shown in any greater detail. The steam generator 1 features a surrounding wall 2 which forms a heating gas duct 6 through which flow is possible in an almost horizontal heating gas direction x, indicated by the arrows 4 for the exhaust gas from the gas turbine. In the heating gas duct 6 are a number of heating surfaces each arranged in accordance with the throughflow principle, also designated as the continuous evaporation heating surface 8, which are provided for the evaporation of the flow medium. Only one continuous evaporating heating surface 8 is shown in the exemplary embodiment in accordance with the FIGURE, but a larger number of continuous evaporating heating surfaces can be provided.

The evaporation system formed from the continuous evaporating heating surface 8 can have a flow medium W applied to it which evaporates on a single pass through the continuous evaporating heating surface 8 and after leaving the continuous evaporating heating surface 8 as already superheated steam D is discharged and merely fed if required for further superheating to superheater heating surfaces. The evaporator system formed from the continuous evaporating heating surface 8 is connected into the water-steam circulation of a gas turbine which is not shown in any greater detail. In addition to the evaporator system a number of further heating surfaces 10 shown schematically in FIG. 1 are connected into the water-steam circulation of the steam turbine. The heating surfaces 10 can for example be superheaters, medium-pressure evaporators, low-pressure evaporators and/or preheaters.

The continuous evaporating heating surface 8 of the steam-generator 1 in accordance with the FIGURE comprises a plurality of steam-generating pipes 12 in the form of a pipe bundle connected in parallel for throughflow by the flow medium W. In this case a plurality of steam-generating pipes 12 viewed in the heating gas direction x, are arranged next to each other. In this case only one of the steam-generating pipes 12 arranged next to one another in this way is visible. A common distributor 16 is connected upstream from the steam-generating pipes 12 arranged next to each other in this way on the flow medium side in each case and a common outlet collector 18 is connected downstream in each case. The distributors 16 are in this case for their part connected on their input side to a main distributor 20, with the outlet collectors 18 being connected on their output side to a main collector 22.

The continuous evaporating heating surface 8 is designed so that it is suitable for feeding the steam-generating pipes 12 with comparatively low mass flow densities, with the steam-generating pipes 12 exhibiting a natural circulation characteristic. With the natural circulation characteristic a steam-generating pipe 12 heated more in comparison with a further steam-generating pipe 12 of the same continuous evaporating heating surface 8 has higher throughflow of the flow medium W in comparison to the further steam-generating pipe 12. To ensure this with especially simple constructive means in an especially reliable way, the continuous evaporating heating surface 8 features three segments connected in series on the flow medium side. In the first segment each steam-generating pipe 12 of the continuous evaporating heating surface 8 features an almost vertically-arranged riser pipe piece 24 through which the flow medium W can flow in an upwards direction. In the second segment each steam-generating pipe 12 features an almost vertically arranged down pipe piece 26 connected downstream from the riser pipe piece 24 on the flow medium side and through which the flow medium W can flow in a downwards direction. In the third segment each steam-generating pipe 12 features a further riser pipe piece 28 arranged almost vertically and connected downstream from the down pipe piece 26 on the flow medium side and through which the flow medium W can flow in an upwards direction.

Viewed in the heating gas direction x the segment formed by the further riser pipe piece 28 is arranged between the segment formed by the first riser pipe pieces 24 and the segment formed by the down pipe pieces 26. This ensures a construction which is matched to a particular degree to the requirements for the heating of the flow medium and to the heating circumstances in the heating gas duct 6.

The down pipe piece 26 is connected to the riser pipe piece 24 assigned to it in this case via a cross flow piece 30. In the same way the further riser pipe piece 28 is connected to the down pipe piece 26 assigned to it via a cross flow piece 30. In the exemplary embodiment the cross flow pieces 30 are routed within the heating gas duct 6. Alternatively the cross flow pieces 30 can also be routed outside the heating gas duct 6. This can be especially useful for the case in which, for constructional or operational reasons, draining of the continuous evaporating heating surface 8 is to be provided.

As can be seen from the FIGURE, a down pipe piece 26 with the further riser pipe piece 28 assigned to it and the cross flow piece 30 connecting the two is shaped almost like a U, with the uprights of the U being formed by the down pipe piece 26 and the further riser pipe piece 28 and the connecting bend being formed by the cross flow piece 30. With a steam-generating pipe 12 designed in this way the geodetic pressure contribution of the flow medium W in the area of the down pipe piece 26—by contrast with the area of the further riser pipe piece 28—creates a flow-promoting and not a flow-inhibiting pressure contribution. In other words: The water column of unevaporated flow medium W located in the down pipe piece 26 "pushes" the throughflow of the relevant steam-generating pipe 12 with it instead of inhibiting it.

This means that the steam-generating pipe 12, viewed overall, exhibits a comparatively low pressure loss.

With this type of construction the two riser pipe pieces 24, 28 and the down pipe piece 26 are hung or fixed onto the cover of the heating gas duct 6 in a kind of hanging construction 44. Viewed spatially, the lower end of the relevant riser pipe piece 24 and the lower end of the relevant down pipe piece 26 and of the further riser pipe piece 28, which are each interconnected by a cross flow piece 30 are by contrast not directly spatially fixed in the heating gas duct 6. Lengthwise expansions of these segments of the steam-generating pipes 12 can thus be tolerated without damage, with the relevant cross flow piece 30 operating as an expansion curve. This arrangement of the steam-generating pipes 12 is thus mechanically especially flexible and insensitive as regards thermal stresses in relation to difference expansions which occur.

Greater heating of a steam-generating pipe 12, especially in its riser pipe piece 24, leads in this case initially to an increase in the evaporation rate, with, because of the dimensioning of the steam-generating pipe 12 as a consequence of this greater heating, an increase in the throughflow rate through the more heated steam-generating pipe 12 occurs.

In addition the down pipe pieces 26 and the further riser pipe pieces 28 of a number of steam-generating pipes 12 are positioned in the heating gas duct 6 relative to one another such that riser pipe pieces 24, 28 lying comparatively far forward viewed in the heating gas direction x are assigned to a down pipe piece 26 lying comparatively far back viewed in the heating gas direction x in each case. Through this arrangement comparatively strongly heated riser pipe pieces 24, 28 communicate with a comparatively weakly heated down pipe piece 26. Through this relative positioning an automatic balancing effect is also achieved between the pipe rows 14 in relation to the throughflow.

As a result of the particularly marked natural circulation characteristic of the steam-generating pipes 12, these exhibit to a particular extent a self-stabilizing behavior in relation to locally different heating: Stronger heating of a row of steam-generating pipes 12 in this case leads locally to an increased feeding of flow medium W into this row of steam-generating pipes 12, so that as a result of the corresponding increased cooling effect an automatic equalization of the relevant temperature values is initiated. The fresh steam flowing into the main collector 22 is thus especially homogeneous as regards its steam parameters, regardless of the individual pipe row 14 through which it has passed.

A particular advantage of the construction of the continuous evaporating heating surface 8 of which the outlet in the form of the further riser pipe pieces 28 on the gas side between the first riser pipe pieces 24 on the one hand and the down pipe pieces 26 on the other hand and is thereby positioned in a mid gas temperature area of the continuous evaporating heating surface 8, lies in the fact that through this positioning too strong a superrheating of the flow medium even in individual steam-generating pipes 12 is avoided in a natural way at the outlet of the continuous evaporating heating surface 8.

The invention claimed is:

1. A steam generator, comprising:

a heating gas duct through which a first medium can flow in a substantially horizontal heating direction; and a plurality of steam-generating pipes connected for a through flow of a second medium and arranged in the heating gas duct, each steam-generating pipe comprising:

a first riser section through which the second medium can flow in an upward direction, the first riser section arranged substantially vertically, a down section in fluid communication to receive the second medium from the first riser section and through which the second medium can flow in a downwards direction, the down section arranged substantially vertically, and a second riser section in fluid communication to receive the second medium from the down section and through which the second medium can flow in an upward direction, the second riser section arranged substantially vertically;

wherein the second riser section is disposed within the heating gas duct between the first riser section and the down section relative to a direction of flow of the first medium, and the first riser section is disposed within the heating gas duct upstream of the second riser section relative to the direction of flow of the first medium.

2. The steam generator in accordance with claim 1, wherein each steam-generating pipe further comprises:

a first cross flow piece that connects the first riser section to the down section, and a second cross flow piece that connects the down section to the second riser section.

3. The steam generator in accordance with claim 2, wherein the first and second cross flow pieces are arranged outside the heating gas duct.

4. The steam generator in accordance with claim 2, wherein each steam-generating pipe is supported with a hanging construction nit within the heating gas duct with a free lengthwise expansion being allowed in each of the first riser, down and second riser sections with the first and second cross flow pieces operating as respective expansion curves for accommodating thermal expansion.

5. The steam generator in accordance with claim 1, wherein a gas turbine is connected to the steam generator upstream on a gas side.

6. The steam generator in accordance with claim 1, wherein the plurality of steam-generating pipes comprise a first pipe and a second pipe disposed generally parallel to each other within the heating gas duct, each of the first pipe and the second pipe comprising respective first riser, down and second riser sections, and further comprising:

the first pipe being disposed upstream of the second pipe relative to the direction of flow of the first medium along their respective first and second riser sections; and the first pipe being disposed downstream of the second pipe relative to the direction of flow of the first medium along their respective down section.

* * * * *